US005347926A

United States Patent [19]

Fantoni et al.

[11] Patent Number: 5,347,926

[45] Date of Patent: Sep. 20, 1994

[54] PRINTING ELEMENT FOR A ROTARY PRINTING MACHINE HAVING A PLURALITY OF RECEIVING CARRIAGES FOR AN IMPRESSION CYLINDER

[75] Inventors: Giuseppe Fantoni, Ozzano Monferrato; Mario Forno, Casale Monferrato; Gianfranco Gibellino, Trino Vercellese; Giampiero Miglietta, Casale Monferrato, all of Italy

[73] Assignee: Officine Meccaniche Giovanni Cerutti S.p.A., Italy

[21] Appl. No.: 88,262

[22] Filed: Jul. 7, 1993

[30] Foreign Application Priority Data

Jul. 10, 1992 [IT] Italy ..... MI92 A 001684

[51] Int. Cl.[5] ..... B41F 5/04

[52] U.S. Cl. ..... 101/219; 101/248

[58] Field of Search ..... 101/219, 216, 218, 212, 101/248, 181

[56] References Cited

U.S. PATENT DOCUMENTS

| | | | |
|---|---|---|---|
| 3,625,145 | 12/1971 | Heatley, Jr. et al. | 101/216 |
| 4,462,311 | 7/1984 | Armelin | 101/218 |
| 5,031,532 | 7/1991 | Walther | 101/248 |

FOREIGN PATENT DOCUMENTS

| | | | |
|---|---|---|---|
| 0234456 | 9/1987 | European Pat. Off. | 101/219 |
| 1086785 | 2/1955 | France | 101/216 |

*Primary Examiner*—Eugene H. Eickholt

*Attorney, Agent, or Firm*—Kirschstein, Ottinger, Israel & Schiffmiller

[57] ABSTRACT

In a rotary printing machine, a pressure roller is mounted on a slide that is reciprocally and linearly moved along two mutually orthogonal directions in order to change impression cylinders.

9 Claims, 4 Drawing Sheets

PRINTING ELEMENT FOR A ROTARY PRINTING MACHINE HAVING A PLURALITY OF RECEIVING CARRIAGES FOR AN IMPRESSION CYLINDER

BACKGROUND OF THE INVENTION

1. Field of the Invention

The present invention relates to a printing element for a rotary printing machine which is equipped with a plurality of carriages, each carriage receiving an impression cylinder.

2. Description of the Related Art

It is known that the aim, even in rotary printing machines, is to avoid the dead times which occur, for example, as a result of a machine standstill during an operation to exchange the receiving carriages for the impression cylinders in the course of a change in production.

If it is assumed that the size of run in printed products produced in a rotary printing machine tends to become smaller in each run, it becomes clear that frequent interruptions in the production of the rotary printing machine in order to exchange the cylinder-receiving carriages, the inking device and the impression cylinder lead to a substantial increase in the machine standstill times. An average person skilled in the art also knows that additional work operations, to be seen, for example, in a stopping of the paper web or a raising of the pressure roller, have to be carried out in order to exchange a receiving carriage for the impression cylinder. The function of the pressure roller is to press the paper web, during the printing operation, against the cylinder provided with a printing plate.

Subsequent to the execution of these and other additional work operations, it will become possible to extract the carriage receiving the impression cylinder from the associated printing element, in order thereafter to introduce a new carriage together with a new impression cylinder.

Furthermore, it is necessary beforehand to prepare the receiving carriage for the printing operations to be carried out and, after the introduction of the carriage, to run the new impression cylinder up to the desired working speed, in order thereafter to bring about a lowering of the pressure roller so as to press the moving paper web onto the new impression cylinder and initiate a printing operation for a new run.

In order to carry out all the above-described operations for a plurality of printing elements when the run is changed, it is necessary, in practice, to stop the entire rotary printing machine, thus leading to a stand-still time of the printing machine for a relatively long period, as a result of which the efficiency of the printing machine drops considerably.

SUMMARY OF THE INVENTION

The object of the present invention is to avoid the disadvantages of the state of the art and to propose a printing element which makes it possible to change automatically from the use of one impression cylinder to a second impression cylinder, this operation being capable of taking place without the need for an interruption of the rotary printing machine.

This object is achieved, according to the invention, by means of a printing element which receives a plurality of impression-cylinder-receiving carriages in the working position and which is characterized in that the pressure roller, by which the paper web is pressed against a rotating impression cylinder, is received at each end by a movable slide which is movable adjustably in its position in a vertical plane, and in that each slide is received by a carriage which is movable adjustably in its position along horizontal guide rails connected to the side parts of the printing element.

With a printing element having these features, it is possible, for the printing of a first run, to use the impression cylinder mounted in a first receiving carriage. If the production is to be changed over, the second impression-cylinder-receiving carriage is prepared, in the machine, for the subsequent printing operation, in that the section impression cylinder is already set in rotational movement in order to reach the rotational speed necessary for the future production. A preparation of the inking device takes place simultaneously, and furthermore an adjustment of the doctor device is carried out.

At the moment when the second impression cylinder arranged in the standby position is to be used for printing a new run, a raising of the pressure roller movable in a vertical plane takes place, and at the same time a horizontal movement of the carriage receiving the pressure roller occurs, until the latter is located above the impression cylinder of the second receiving carriage. A downward movement of the slide takes place thereafter, in order to press the paper web once again by means of the pressure roller against the second impression cylinder which is available for the new printing operation.

During this change of production, which is an operation taking place at considerable speed, the movement of the paper web is not interrupted and virtually no machine standstill time occurs. It is thereby possible to avoid serious technical disadvantages, to be seen, for example, in a tearing of the paper web which often occurs when a rotary printing machine is being run up again.

The first receiving carriage of the impression cylinder, which is now no longer in use, can be moved out of the printing element and be replaced by a third receiving carriage for an impression cylinder which is already equipped for printing a subsequent run.

BRIEF DESCRIPTION OF THE DRAWINGS

The subject of the invention is now described in more detail and illustrated in the drawings by means of an exemplary embodiment. In these.

DETAILED DESCRIPTION OF THE PREFERRED EMBODIMENTS

Figure 1:
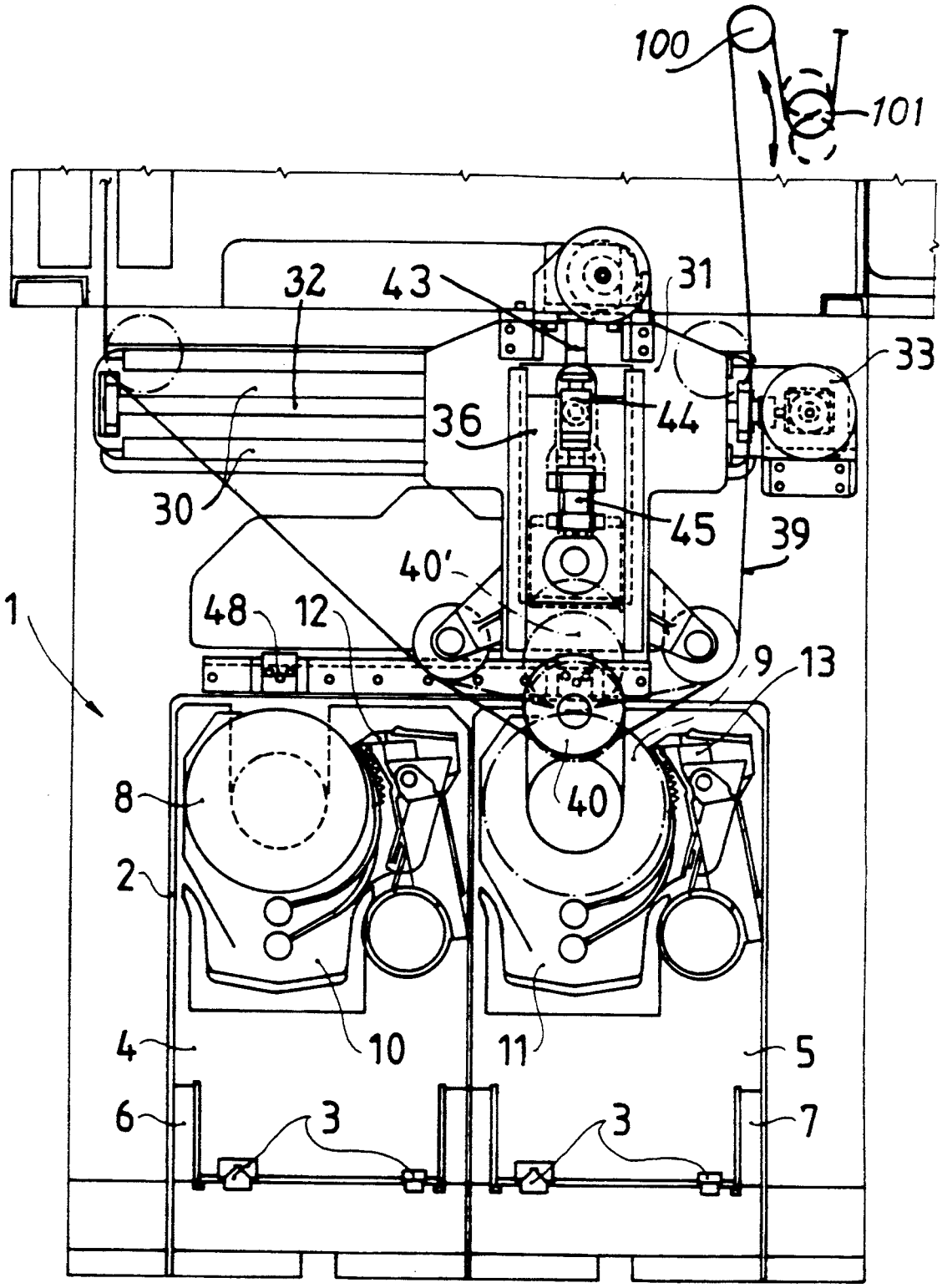
FIG. 1 shows a front view of a printing element with two impression-cylinder-receiving carriages and with a device for moving the pressure roller.

As can be taken from FIG. 1, the printing element, designated as a whole by 1, has in the lower part a recess 2 which, by the use of precision guides 3, receives carriages 4 and 5 equipped with running rollers 6 and 7.

Each carriage is equipped with an impression cylinder 8 and 9 as well as with an inking device 10 and 11 and a doctor device 12 and 13.

As shown diagrammatically in the drawings, parallel guide rails, designated as a whole by 30, are arranged on the two side parts of the printing element 1 above the recess 2 for receiving the carriages 4 and 5 of the impression cylinders 8, 9. The guide rails 30 are arranged horizontally and receive a movable carriage 31 which is connected operatively to a precision drive spindle 32, advantageously a ballscrew spindle, in order thereby to allow a movement and positioning of the carriage 31 with high accuracy. The spindle 32 is driven via a motor 33, advantageously a controllable direct-current motor.

The displacement of the carriage 31 could also take place by means of one or more piston/cylinder units which, for this purpose, are connected operatively to the movable carriage and to the frame of the machine. In this case, the exact position of the carriage 31 is obtained by means of stops, advantageously stops of adjustable position.

It has proved advantageous that the paper web 39 to be printed by the cylinder 8 or the cylinder 9 is guided via a roller 100 at the entrance of the printing element. A pivotably mounted dancing roller 101 is also advantageously provided, in order to allow a compensation in the pull, to which the paper web 39 is exposed, during the movement of the carriage 31 along the guide rails 30.

Each carriage 31 has vertically arranged sliding rails 34 and 35 forming precision parallel guides for a slide 36 which receives a pressure roller 40 as well as rollers 37 and 38 for guiding the paper web 39. By means of the pressure roller 40, the paper web 39 is pressed in a known way against the associated impression cylinder 8 or 9.

The upper part of the carriage 31 receives a drive motor 41, advantageously a controllable motor which, via an angle drive 42, drives a threaded spindle 43 connected operatively to the body of the slide 36. The threaded spindle 43 is connected, with a connection piece 44 interposed, to a piston/cylinder unit 45, by means of which the slide 36 can quickly be set in a raising or lowering movement.

Advantageously each side part of the printing element designated by 1 is connected to a horizontally arranged strip 46, on which are arranged stop means 47 and 48 or electrical limit switches which serve as stops, in order to fix the working position of the slide 31 and its movement stroke in the horizontal direction. A specific position of the slide and therefore of the pressure roller 40 relative to the impression cylinder 8 or 9 used for the printing operation can thus be set with accuracy.

Figure 3:
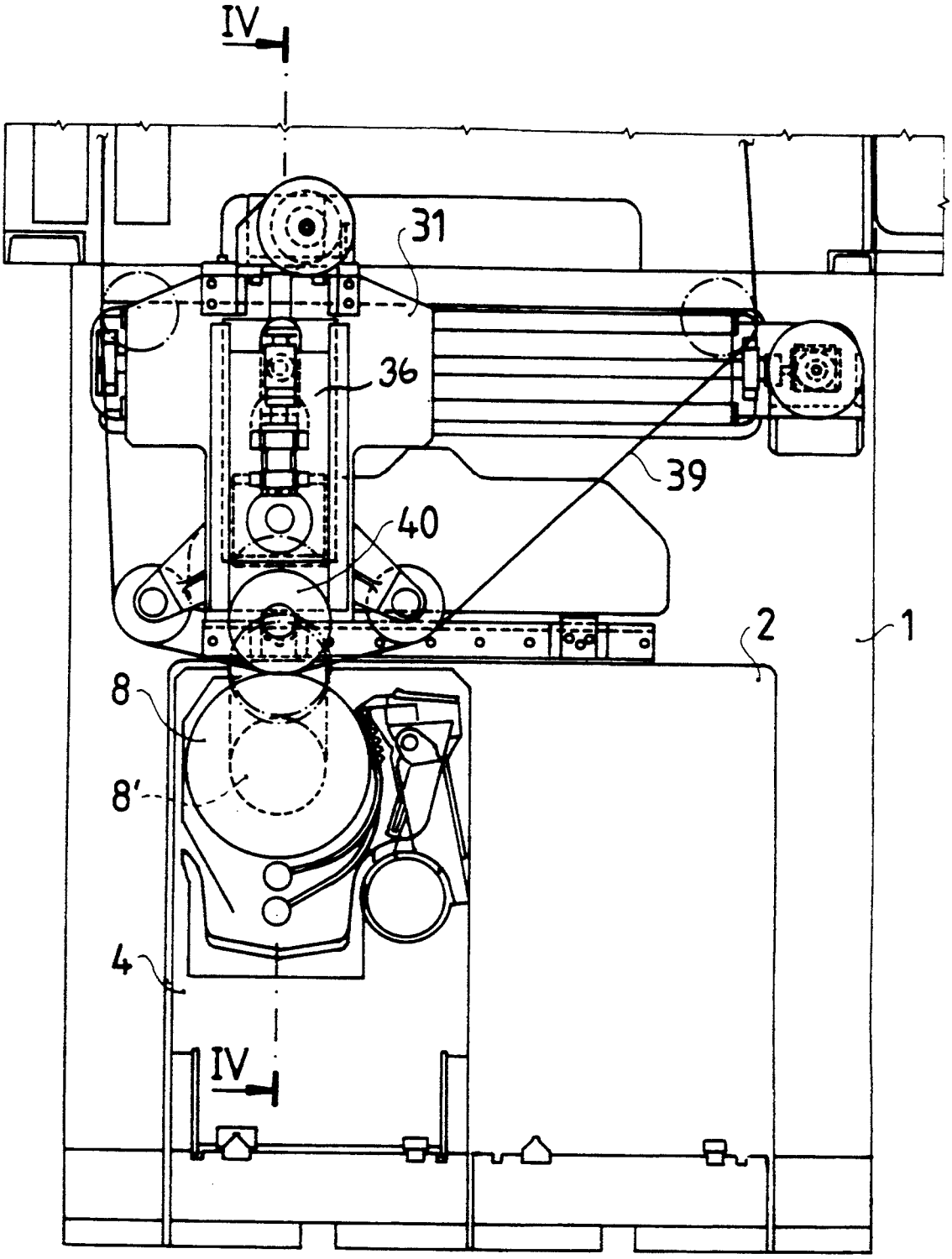
FIG. 3 shows a front view of the printing element with the pressure roller in cooperation with a second cylinder, whilst the receiving carriage of the first cylinder has already been moved out.

Whereas, in FIG. 1, the orifice 2 of the printing element 1 is occupied by two cylinder-receiving carriages 4 and 5, it can be taken from FIG. 3 that the orifice 2 of the printing element is occupied only by a second impression-cylinder-receiving carriage 4; the first impression-cylinder-receiving carriage 5 has already been moved out.

In this position, the pressure roller 40 presses the paper web 39 onto the impression cylinder 8, and it is possible to introduce into the free space 2 a new impression-cylinder-receiving carriage which has already been prepared outside the printing element 1 for the subsequent printing operation.

It can be taken from FIG. 3 that it is possible to bring the pressure roller 40 into operative connection with an impression cylinder 8 having a larger diameter, or, by a further lowering of the roller 40 (as represented by broken lines), the latter can also be brought into working contact with a cylinder 8' having a smaller diameter.

Figure 2:
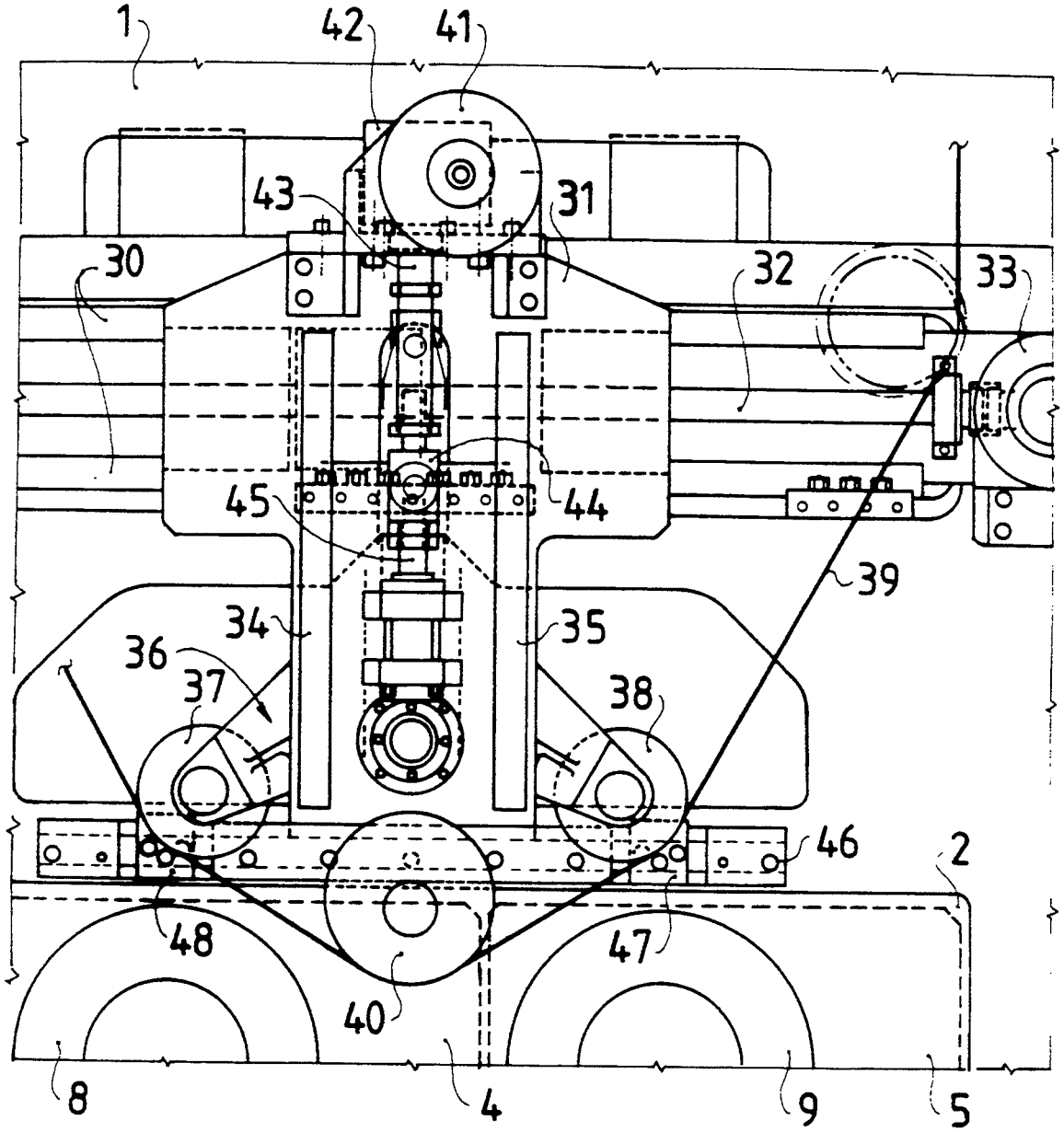
FIG. 2 shows a front view of the device for moving the pressure roller in an intermediate position.
Figure 4:
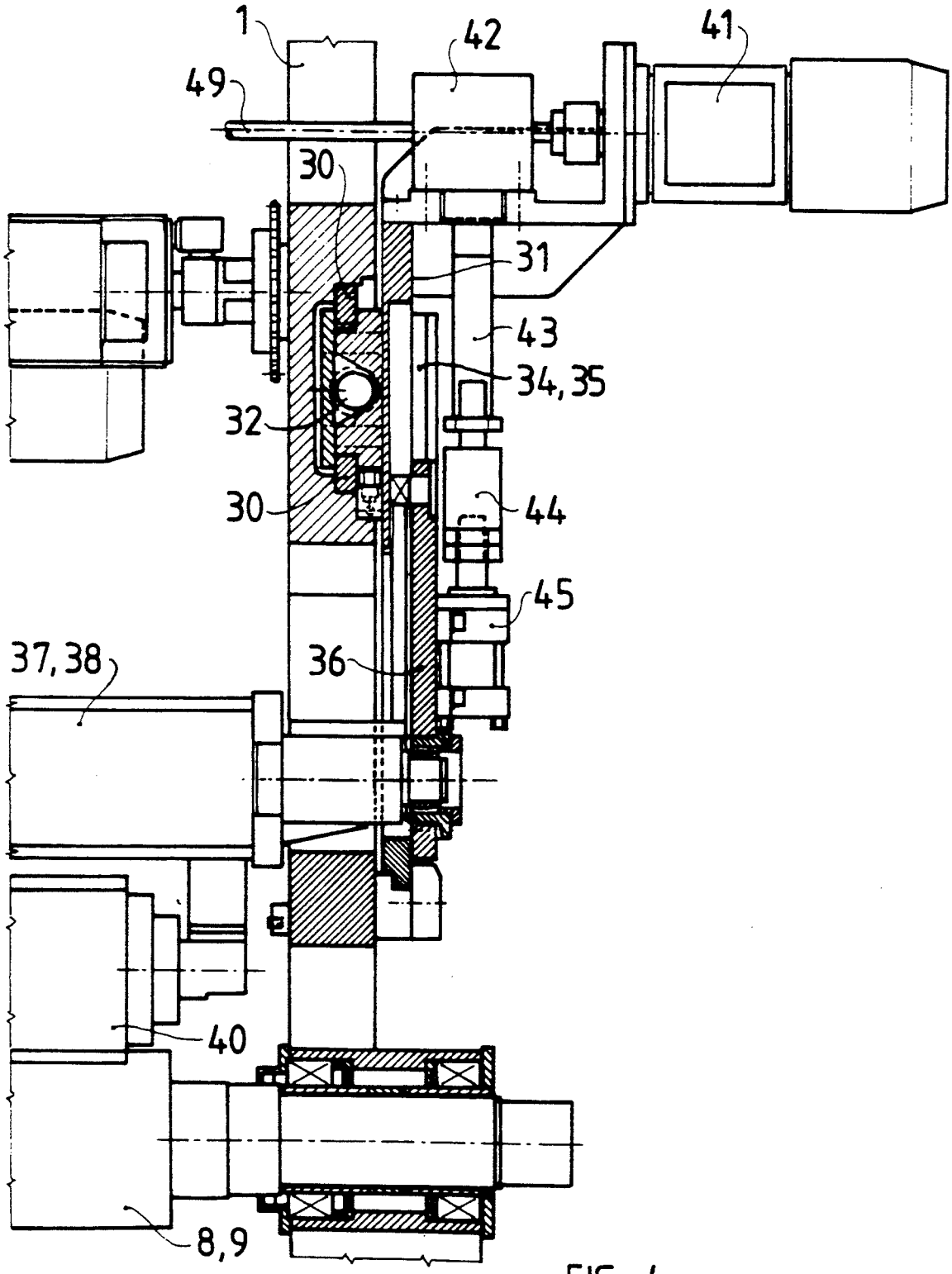
FIG. 4 shows the displacement device of the pressure roller and the impression cylinder in cross-section along the line IV—IV of FIG. 1.

FIG. 4 shows the device according to the invention, together with its essential components, in a longitudinal section along the line IV—IV in FIG. 2.

A side part of the printing element 1 can be seen. The movable slide 31 is arranged inside the printing element 1 and can be moved along the parallel guides 30 by means of the spindle 32. On the top side, the carriage receives a controllable motor 41 which sets the shaft 43 in rotational movement via an angle drive 42. As can be taken from the drawing, an extension rod 49 branches off from the angle drive 42 and is suitable also for driving a spindle 43 which is arranged on a second side part (not shown) of the printing element 1.

The threaded spindle 43 is connected operatively by means of a connection piece 44 to a piston/cylinder unit 45, and the latter is connected to the slide 36 which is arranged displaceably in the vertical direction between two parallel guide strips 34, 35.

The slide 36 receives rotatably mounted rollers 37, 38 which serve for guiding the paper web 39, the paper web being pressed by the pressure roller 40 against one of the two impression cylinders 8 and 9 which are used for production.

The mode of operation of the device according to the invention is as follows:

When the carriage 4 and 5 receiving the impression cylinders 8 and 9 is introduced into a printing element 1, the pressure roller is located, for example, above the first cylinder 9 which, at this moment, constitutes the working cylinder. The pressure roller 40 presses the moving paper web 39 against the impression cylinder 9. The impression cylinder 8 constitutes a replacement cylinder which is in the standby position and which has been prepared for a subsequent printing operation.

As soon as a change of production is to take place, the piston/cylinder unit 45 is actuated and the pressure roller 40 is raised from the impression cylinder 9 located underneath it, with the result that the moving paper web 39 lifts off from the impression cylinder 9. The paper web continues its movement constantly, and, as a result of the actuation of the motor 41 and the use of the angle drive 42 and drive spindle 43, there occurs a raising of the slide together with the pressure roller 40 which is moved into a position 40', in which it becomes possible to move the carriage 31 quickly along the guides 30 via the motor 33 as a result of the actuation of the ballscrew spindle 32. This takes place until the pressure roller 40 is exactly above the second impression cylinder 8 which, in the meantime, has been run up to the nominal speed and the inking unit of which has already been prepared for the subsequent printing operation. The doctor device of the cylinder has already been adjusted and the cylinder 8 has already been set in rotational movement. In this position which is fixed by the associated limit stop 48, as shown in FIG. 1, a renewed lowering of the slide 36 and of the pressure roller 40 takes place, the latter being brought into operative connection with the cylinder 8 or 8' of the carriage 9. A resumption of the printing operation can thus take place after the shortest possible time.

It is possible thereafter to move the first impression-cylinder-receiving carriage 5 out of the printing element, in order to introduce into the free space 2 a new impression-cylinder-receiving carriage which remains in the standby position and which will be used for the production of a subsequent run.

If the intention is to adjust the printing operation to a new run once again, then the operations of raising, moving and lowering the pressure roller 40 take place in the opposite way to that described in the foregoing.

We claim:

1. An arrangement for changing impression cylinders in a rotary printing machine through which a web is guided, comprising:

a first carriage having a first impression cylinder mounted thereon for rotary movement about a first axis;

a second carriage having a second impression cylinder mounted thereon for rotary movement about a second axis that is generally parallel to, and spaced transversely along a longitudinal direction away from, the first axis;

a slide mounted on the machine for movement along the longitudinal direction, and also for movement along an elevation direction that is generally perpendicular to the longitudinal direction and said axes;

a pressure roller mounted on the slide for joint movement therewith;

elevation drive means for reciprocally and linearly moving the slide and the pressure roller along the elevation direction between working positions in each of which the pressure roller presses the web into engagement with a respective impression cylinder, and transit positions in each of which the pressure roller is spaced away from the respective impression cylinder; and longitudinal drive means for reciprocally and linearly moving the slide and the pressure roller along the longitudinal direction between the transit positions.

2. The arrangement according to claim 1, wherein each carriage has means for inking a respective impression cylinder, and means for removing excess ink from the respective impression cylinder.

3. The arrangement according to claim 1; and further comprising a pair of guide rollers on the slide and sequentially arranged along the web.

4. The arrangement according to claim 1; and further comprising another slide, said slides being arranged at opposite axial sides of the machine; and wherein the elevation drive means includes a pair of elevation drive assemblies at each of said sides; and wherein the longitudinal drive means includes a pair of longitudinal drive assemblies at each of said sides.

5. The arrangement according to claim 4, wherein each elevation drive assembly is mounted on upright, stationary guide rails fixed to the machine.

6. The arrangement according to claim 4, wherein each longitudinal drive assembly is mounted on horizontal, stationary guide tracks fixed to the machine.

7. The arrangement according to claim 5, wherein the elevation drive means includes a piston-cylinder unit for each elevation drive assembly, a common electrical drive motor, and a force-transmitting transmission for connecting the motor to each unit.

8. The arrangement according to claim 6, wherein the longitudinal drive means includes a spindle for each longitudinal drive assembly and a common electrical drive motor for rotating each spindle.

9. The arrangement according to claim 1; and further comprising a pair of stops spaced apart along the longitudinal direction for preventing movement of the slide past the transit positions.

* * * * *